United States Patent [19]

Nakamura

[11] Patent Number: 4,745,872

[45] Date of Patent: May 24, 1988

[54] HANDLE DEVICE FOR JET-PROPELLED SMALL-SIZED BOAT

[76] Inventor: Yukio Nakamura, 3-19, 1-Chome, Tengachayakita, Nishinari-Ku, Osaka-Shi, Osaka-Fu, Japan

[21] Appl. No.: 1,771

[22] Filed: Jan. 9, 1987

[51] Int. Cl.[4] ..... B63B 35/86

[52] U.S. Cl. ..... 114/270; 114/144 R; 74/551.3

[58] Field of Search ..... 114/270, 144 R; 440/40; 74/551.1, 551.3, 551.4, 551.5

[56] References Cited

U.S. PATENT DOCUMENTS

| | | | |
|---|---|---|---|
| 624,296 | 5/1899 | Castle | 74/551.4 |
| 2,943,593 | 7/1960 | Megart, Jr. et al. | 440/40 |
| 3,481,303 | 12/1969 | Tate et al. | 114/270 |
| 3,710,750 | 1/1973 | Welsh | 114/270 |
| 4,350,113 | 9/1982 | Moreau et al. | 114/270 |

FOREIGN PATENT DOCUMENTS

| | | |
|---|---|---|
| 24519 | 8/1975 | Japan . |
| 7910 | 3/1976 | Japan . |
| 6237 | 2/1978 | Japan . |
| 33352 | 8/1978 | Japan . |
| 40636 | 11/1979 | Japan . |
| 43355 | 10/1984 | Japan . |

OTHER PUBLICATIONS

Jet Ski Watercraft Parts Catalogue (excerpt, by Kawasaki Heavy Industries, Ltd.

Magazine for Jet Skier, Jet Ski World.

*Primary Examiner*—Sherman D. Basinger

*Attorney, Agent, or Firm*—Armstrong, Nikaido, Marmelstein & Kubovcik

[57] ABSTRACT

A handle device for a jet-propelled small-sized boat wherein a handle post is pivotally connected to the stem of the boat so that it can be tilted around the axis of a transverse shaft and a handle bar is fixed to the upper end of said post by an attaching bracket, the handle device being characterized in that: the attaching bracket is made in two parts, a front bracket and a rear bracket, the front bracket being attached to the handle post and the rear bracket to the handle bar, the position at which the rear bracket is connected to the front bracket being adjustable by sliding the rear bracket longitudinally of the boat. Thus, it is made possible to readily cope with the rider's physical build and steering technique which vary from rider to rider, and to change the position of the step-on pressure applied to the boat.

1 Claim, 2 Drawing Sheets

HANDLE DEVICE FOR JET-PROPELLED SMALL-SIZED BOAT

BACKGROUND OF THE INVENTION

Generally, jet-propelled small-sized boats adapted to glide freely over water surface are designed so that a single person is allowed to ride the boat in a standing posture on the floor deck at the stern, enjoying interesting sports and games by changing his steering posture and step-on pressure position.

In conventional boats of this type, however, since the support post for the handle bar is merely pivotally connected to the stem so that it can be tilted around the axis of a transverse shaft, the following problem arises.

The handle post performs arcuate movement around the axis of the horizontal pivot shaft at the lower end; thus, when the level of the handle bar fixed to the upper end thereof is increased, the attaching position of the bar is displaced to the advanced position and, reversely, when it is decreased the attaching position is displaced to the retracted position. Thus, the standing position of the rider is consequently influenced by such changes in the level of the handle bar and the steering operation is limited in changing the position of step-on pressure applied to the boat, making it impossible to cope with the rider's physical build and steering technique which vary from rider to rider.

SUMMARY OF THE INVENTION

The present invention has been accomplished to solve said problem and an object of the invention is to provide an arrangement wherein an attaching bracket is interposed between said handle post and said handle bar, said attaching bracket being made in two parts, a front bracket and a rear bracket, said front bracket being attached to the handle post and said rear bracket to the handle bar, the position at which the rear bracket is connected to the front bracket being adjustable by sliding the rear bracket longitudinally of the boat, so that even if the level of the attaching position of the handle bar is changed, the standing position of the rider is not limited by such change, thereby ensuring the attainment of stabilized steering according to the rider's physical build and steering technique all the time.

Another object of the invention is to provide an arrangement wherein at the same time as the position at which the rear bracket is connected to the front bracket is made adjustable by sliding the rear bracket longitudinally of the boat, the handle bar is pivotally connected to the rear bracket for angular adjustment around the axis of a vertical shaft, thereby making it possible for the rider to grip the handle bar more easily and steer the boat with higher mobility according to the rider's physical build.

DESCRIPTION OF THE PREFERRED EMBODIMENTS

Figure 1:
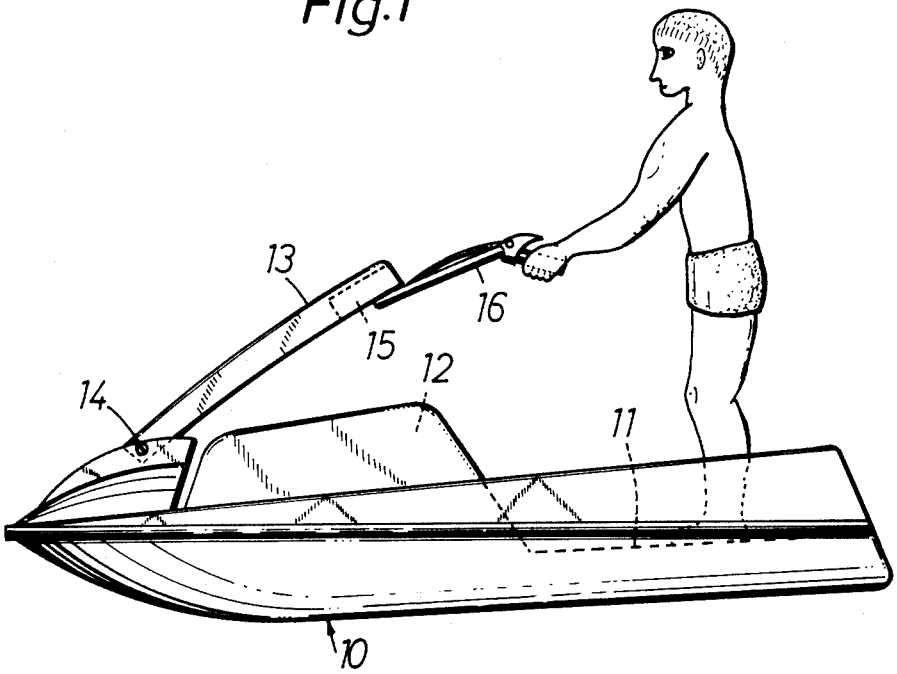
FIG. 1 is a schematic side view of a jet-propelled small-sized boat in its entirety according to the present invention.

The concrete arrangement of the invention will now be described with reference to the drawings. FIG. 1 shows a jet-propelled small-sized boat in its entirety. The numeral 10 denotes a boat body constructed of fiber-reinforced plastic (FRP) or the like in the form of a hollow enclosed body as a whole, the stern serving as a floor deck 11 for the rider to stand thereon during the use of the boat. The numeral 12 denotes an engine room formed in the front portion of the boat, but the engine installed therein is omitted from the illustration.

The numeral 13 denotes a handle post pivotally connected to the stem by a horizontal transverse shaft 14 so that it can be tilted around the axis of said shaft 14, and the upper end of the handle post opposed to the floor deck 11 is fixedly provided with a handle bar supporting base block 15. A handle bar 16 is fixedly installed on the base block 15 by an attaching bracket generally denoted by A in the following manner.

Figure 2:
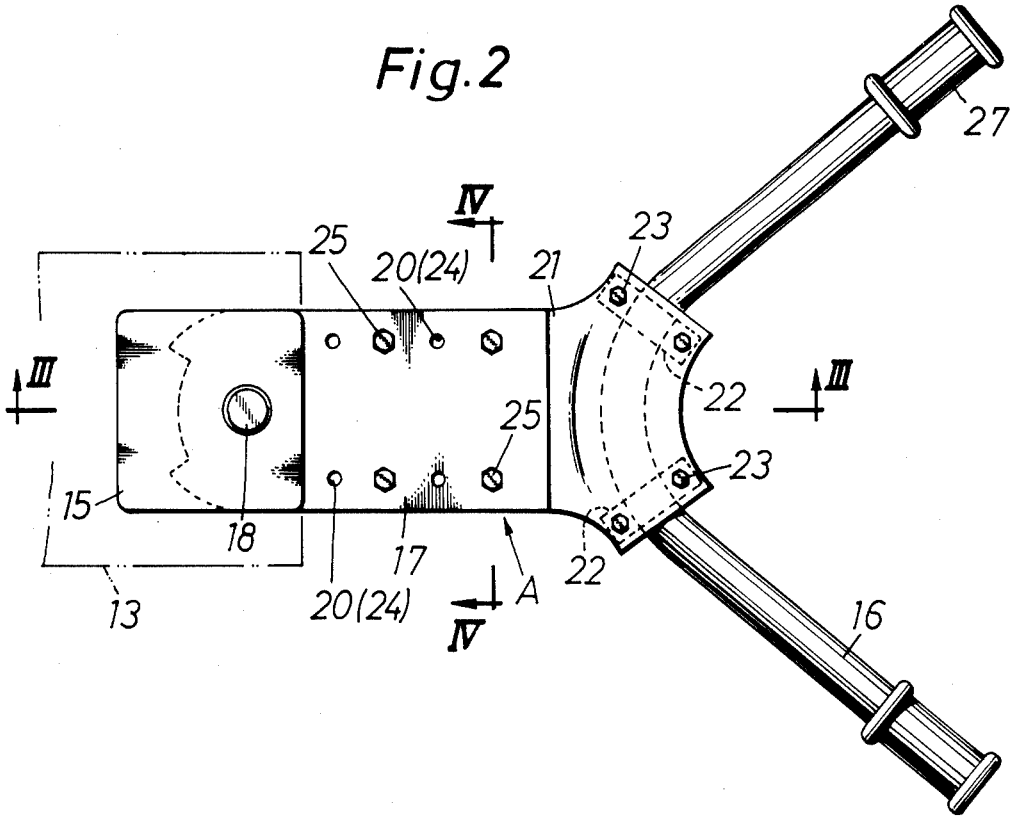
FIG. 2 is a principal enlarged plan view of a handle device shown separated from said boat.
Figure 3:
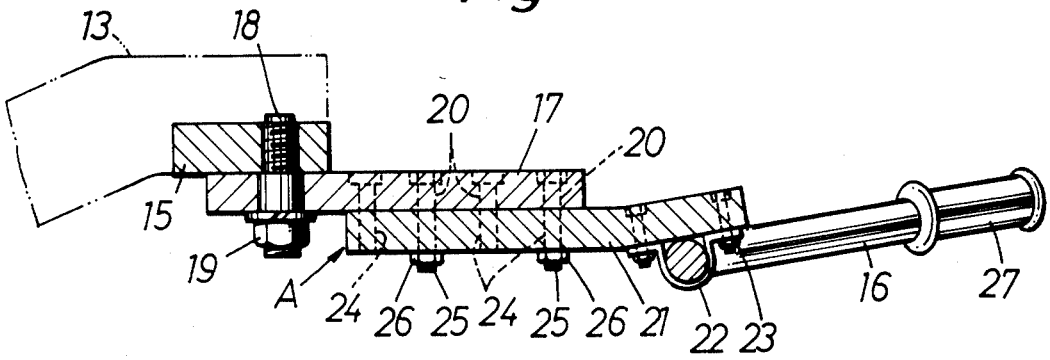
FIGS. 3 and 4 are enlarged sectional views taken along the lines III—III and IV—IV, respectively, in FIG. 2.
Figure 4:
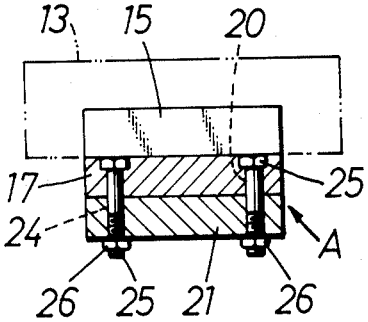

In FIGS. 2 through 4 illustrating the same, a front bracket 17 in the form of a metal plate is integrally assembled to the base block 15 by means of a stud bolt 18 extending from the front middle position on said front bracket and a fixing nut 19 screwed on said stud bolt. The numeral 20 denotes a plurality of pairs of suitably spaced bolt receiving holes arranged in two longitudinal rows, said holes being in the form of stepped plain holes.

On the other hand, a rear bracket 21 paired with the front bracket 17 is in the form of a metal plate which is somewhat bent upward in its rear end region, while a handle bar 16 in the form of a single metal pipe bent in L-shape is fixed at its middle to said rear end region by a pair of clamp elements 22 and attaching bolts 23.

In the front position on said rear bracket 21, there are a plurality of suitably spaced bolt passage holes 24 in the form of plain holes arranged in two longitudinal rows. The pair of brackets 17 and 21 are separably connected together in a unit by at least a pair of connecting bolts 25 inserted in holes 20 and 24 which are selectively aligned with each other and fixing nuts 26 screwed on said connecting bolts.

In other words, the attaching bracket A comprises the assembly of the front and rear brackets 17 and 21 and is arranged so that the position at which the handle bar 16 is attached to the handle post 13 can be changed or adjusted by selectively re-inserting the bolts 25, sliding the rear bracket 21 with respect to the front bracket 17 longitudinally of the boat body 10, and fixing said front and rear brackets together.

Thus, by selective re-insertion of the connecting bolts 25, coupled with the tilting movement of the handle post 13 itself, the rider's physical build and steering technique which vary from rider to rider can be coped with; thus, the step-on pressure position (the position of center of gravity) to apply pressure to the boat body 10 can be freely changed. In addition, the numeral 27 denotes the grips for the handle bar 16.

Figure 6:
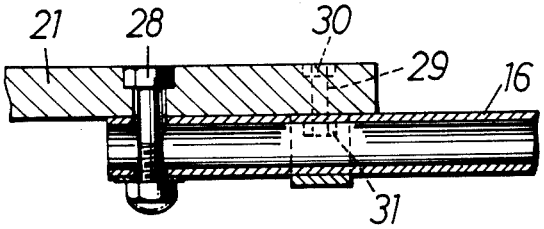
FIG. 6 is a fragmentary enlarged sectional view taken along the line VI—VI in FIG. 5.
Figure 5:
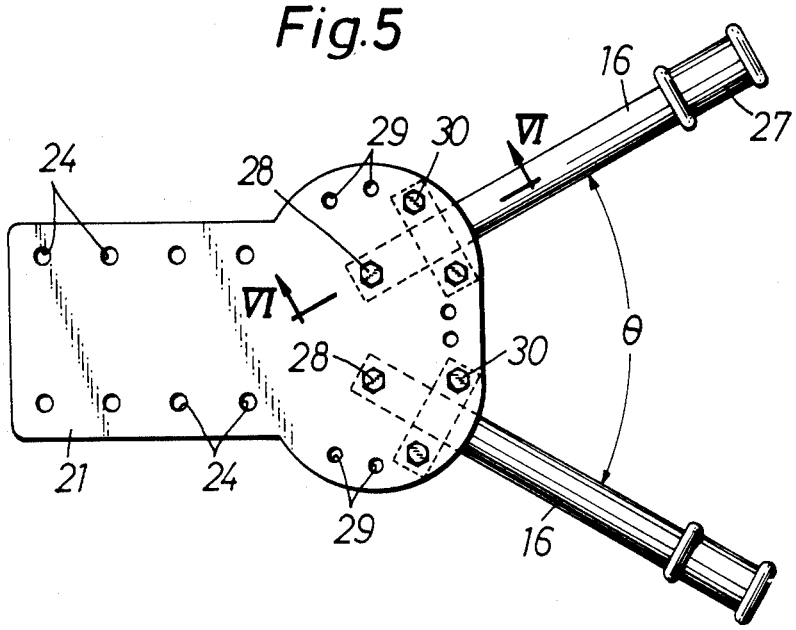
FIG. 5 is a plan view corresponding to FIG. 2, but showing a modified embodiment of the invention.

FIGS. 5 and 6 shows a modified embodiment of the invention, wherein in attaching the handle bar 16 to the rear bracket 21, the following arrangement is employed.

The handle bar 16 described in the first embodiment is divided into two parts, each being pivotally mounted on a vertical shaft 28 so that it can be rotated around the axis of said vertical shaft 28. Furthermore, the rear region of the rear bracket 21 is formed with a plurality of bolt insertion holes 29 at positions on an arc of definite radius with the center at the axis of each vertical shaft 28, so that the handle bar 16 can be fixed in position by inserting fixing bolts 30 in selected holes 29 and screwing clamp nuts 31 thereon.

According to this arrangement, the angle of rotation $\theta$ of the handle bar 16 can be adjusted by selectively re-inserting the bolts 30; thus, this is more effective in achieving the objects of the invention described above. In addition, since the rest of the arrangement in this modified embodiment is substantially the same as in the basic embodiment shown in FIGS. 2 through 4, reference characters corresponding to those shown in FIGS. 2 through 4 are entered in FIGS. 5 and 6 and a detailed description thereof is omitted.

At any rate, so long as the attaching position of the handle bar 16 can be adjusted by sliding the handle bar longitudinally of the boat, it is also possible to employ arrangements other than those shown herein. For example, instead of distributively providing said bolt receiving holes 20 and bolt passage holes 24, it is possible to distributively providing a plurality of mutually engageable recessed and raised portions on the pair of brackets 17 and 21 or by providing said brackets with elongated openings or rails for slide guide.

As described above, the handle post 13 is pivotally connected to the stem of the boat 10 by means of the horizontal transverse shaft 14 so that it can be tilted around the axis of said shaft 14. Thus, where the level of the handle bar 16 positioned on the upper end of the post 13 is changed by an arcuate movement of the post 13 according to its tilting operation, the rider has to move to the forward region of the floor deck 11 when said level is increased, in order to hold the grips 27 in a stabilized manner. This results in a change in the position of the center of gravity of the boat body 10 including the rider's weight. On the other hand, when the level of the handle bar 16 is decreased, the rider has to move to the rear region of the floor deck 11 and hence the position of the center of gravity of the boat 10 inevitably changes.

In this respect, according to the present invention, since the position of connection between the front bracket 17 having the handle post 13 attached thereto and the rear bracket 21 having the handle bar 16 attached thereto is adjustable by slide movement longitudinally of the boat, the aforesaid problem can be solved by adjusting the rear bracket 21 with respect to the front bracket 17. Even though the rider's physical build or steering technique varies from rider to rider, it is possible for the rider to easily hold the grips 27 in his optimum standing posture. Further, the position of the center of gravity of the boat 10 can be stably set according to the purpose of steering. The arrangement required therefor is simple as a whole and suited for mass production.

What is claimed is:

1. A jet-propelled small-sized boat, wherein the engine is mounted in a front portion thereof and a floor deck is disposed in the stern, thereof, said boat comprising:

a handle post pivotally connected at its front lower end to the stem of the boat by a transverse shaft so that it can be tilted around the axis of said shaft, an attaching bracket for a handle bar pivotally connected to the rear upper end of the handle post, opposed to the floor deck, by a stud bolt so that said attaching bracket is pivotable around a vertical axis of said bolt, said attaching bracket including, (a) a front bracket, and (b) a rear bracket, which are each formed of a metal plate and which can be joined together, a front end of the front bracket being pivotally connected to the rear upper end of the handle post such that it is pivotable about said stud bolt, the handle bar formed of a metal pipe bent in an L-shape in a plan view extends from a rear end of the rear bracket, a plurality of bolt receiving holes, a pair on each of opposite sides, are formed in the plate surface of the front bracket in order to be selectively aligned with a plurality of bolt passage holes, a pair on each of opposite sides, formed in the plate surface of the rear bracket so as to correspond to said bolt receiving holes, and connecting bolts, a pair on each of opposite sides, are inserted into said bolt receiving holes and bolt passage holes and fixing nuts are fitted thereon, whereby the connecting position of the rear bracket with respect to said front bracket can be adjusted by being slid longitudinally of the boat, so that the direction of the boat may be changed by the changing of the stand-on pressure on the floor deck by the rider to thus change the center of gravity to steer the boat.

* * * * *